US008516726B2

(12) United States Patent
Glass

(10) Patent No.: US 8,516,726 B2
(45) Date of Patent: Aug. 27, 2013

(54) AUDIO GIFT TAG FOR CONTAINER ATTACHMENT

(75) Inventor: Brett R. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/249,073

(22) Filed: Sep. 29, 2011

(65) Prior Publication Data

US 2012/0255882 A1 Oct. 11, 2012

Related U.S. Application Data

(60) Provisional application No. 61/387,829, filed on Sep. 29, 2010.

(51) Int. Cl.
*G09F 1/00* (2006.01)

(52) U.S. Cl.
USPC ..... 40/124.03; 40/124.06; 40/310

(58) Field of Classification Search
USPC ..... 40/310, 124.03, 124.06; 222/39
See application file for complete search history.

(56) References Cited

U.S. PATENT DOCUMENTS

| | | | | |
|---|---|---|---|---|
| 973,731 | A | 10/1910 | Watkins | |
| 1,796,398 | A | 3/1931 | Richardson | |
| 1,865,835 | A | 7/1932 | Colby | |
| 2,976,629 | A | 3/1961 | Brixius et al. | |
| 4,611,262 | A | 9/1986 | Galloway et al. | |
| 4,677,657 | A | 6/1987 | Nagata et al. | |
| 4,791,741 | A | 12/1988 | Kondo | |
| 4,951,596 | A | 8/1990 | Wallace, Jr. | |
| 5,045,327 | A | 9/1991 | Tarlow et al. | |
| 5,056,659 | A | 10/1991 | Howes et al. | |
| 5,063,698 | A | 11/1991 | Johnson et al. | |
| 5,275,285 | A | 1/1994 | Clegg | |
| 5,283,567 | A | 2/1994 | Howes | |
| 5,387,108 | A | 2/1995 | Crowell | |
| 5,439,103 | A | 8/1995 | Howes | |
| 5,464,092 | A | 11/1995 | Seeley | |
| 5,480,156 | A | 1/1996 | Doederlein et al. | |
| 5,489,893 | A | 2/1996 | Jo et al. | |
| 5,575,383 | A | 11/1996 | Seeley | |
| 5,625,347 | A | 4/1997 | MacLean et al. | |
| 5,778,574 | A | 7/1998 | Reuben | |
| 5,862,937 | A * | 1/1999 | Carrizales et al. | 220/501 |
| 5,905,429 | A | 5/1999 | Hornstein et al. | |
| 5,938,199 | A | 8/1999 | Doederlein et al. | |
| 5,960,973 | A | 10/1999 | Markson | |
| 5,969,592 | A | 10/1999 | Reed | |
| 6,024,625 | A | 2/2000 | Pearce | |
| 6,037,872 | A | 3/2000 | Dunnum | |
| 6,298,990 | B1 | 10/2001 | Amrod et al. | |
| 6,335,691 | B1 | 1/2002 | Bird | |
| 6,385,874 | B1 * | 5/2002 | Tsonas | 40/124.09 |
| 6,525,660 | B1 | 2/2003 | Surintrspanont | |
| 6,545,594 | B1 | 4/2003 | Knight et al. | |
| 6,771,165 | B2 | 8/2004 | Burg II et al. | |

(Continued)

FOREIGN PATENT DOCUMENTS

GB 2227591 A * 8/1990

*Primary Examiner* — Gary Hoge
(74) *Attorney, Agent, or Firm* — Polsinelli PC

(57) ABSTRACT

An audio gift tag assembly including means for removably attaching the assembly to the neck of a container. In certain embodiments, the assembly includes means for receiving and holding a transaction card, such as a gift card.

10 Claims, 8 Drawing Sheets

(56) References Cited

U.S. PATENT DOCUMENTS

| | | | | |
|---|---|---|---|---|
| 7,185,452 | B2 | 3/2007 | Brown | |
| 2002/0097195 | A1 | 7/2002 | Frank | |
| 2003/0121721 | A1 | 7/2003 | Dudkin | |
| 2003/0226298 | A1 | 12/2003 | Bjork | |
| 2005/0077372 | A1 * | 4/2005 | Greenberg | 239/33 |
| 2006/0181410 | A1 | 8/2006 | Staples | |
| 2007/0024465 | A1 | 2/2007 | Howell et al. | |
| 2007/0241910 | A1 | 10/2007 | Marsilio et al. | |
| 2007/0284269 | A1 * | 12/2007 | Star | 206/307 |
| 2008/0047178 | A1 | 2/2008 | Marszalek | |
| 2009/0031597 | A1 | 2/2009 | Powell et al. | |
| 2009/0032550 | A1 * | 2/2009 | Touron | 222/39 |

* cited by examiner 100
105
110
115
125
240
245
250
265
270
275
280
285
290

AUDIO GIFT TAG FOR CONTAINER ATTACHMENT

CROSS REFERENCE TO RELATED APPLICATION

This application claims the benefit of the prior filed, co-pending provisional application Ser. No. 61/387,829 filed Sep. 29, 2010.

BACKGROUND OF THE INVENTION

This invention relates generally to gift cards and more particularly to a device for holding a gift card to the neck of a bottle, such as a wine bottle.

Transaction cards, stored value cards, or gift cards as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, more commonly, is selected at the point of sale by the purchaser and loaded by the cashier using a magnetic card reader/writer.

Holders for gift cards have been used simply to store gift cards and also to provide a surface for decorative indicia and graphics, as well as personalized or preprinted text. Gift card holders that provide user initiated sound are also known.

Devices for attachment to bottles and other containers include clips for attaching tags, labels or cards to the necks of bottles, such as devices disclosed in U.S. Pat. Nos. 973,731; 1,796,398; 1,865,835; 2,976,629; and 5,960,973.

What is needed is a device that allows a gift tag with audio playback features and, in some embodiments, a pocket or sleeve for holding a gift card, to be removeably attached to a container, such as a wine or spirit bottle of the type often given as a gift.

BRIEF DESCRIPTION OF THE INVENTION

The purpose of this invention is to provide a means for attaching a gift tag incorporating audio features to the neck of a bottle, such as a bottle for holding wine or spirits. The tag may further comprise a card holder for holding a transaction card, such as a gift card, to or within the tag. The tag typically includes indicia for indicating both the name of the sender and recipient of the gift card, and decorations of various styles or themes. Certain embodiments also include one or more pockets, sleeves or slots for inserting a gift card into the holder, or are provided with other means for holding the gift card to or within the holder structure. The tag is mounted on an attachment member, such as strap, that passes over or around the neck of a bottle. The tag may include electronics for recording and playing sound such as music and/or a message from the gift giver. The electronics may include a sound speaker, a power source, such as one or more commonly available watch batteries, a processor or control circuit, a memory chip for storing sound recordings, and record and playback buttons.

Certain embodiments of the invention comprise an audio tag assembly for attachment to the neck of a container. Such an assembly includes a tag member mounted on a container attachment member, the tag member including a chamber to house audio components and a slot for receiving and storing a transaction card. The attachment member includes a first loop that projects downward from the tag member and encircles a first, major aperture sized for receiving and encircling the lower portion of the neck of a container. The lower portion of the neck is typically proximate a location on the container where the neck merges into or joins the main body of the container. This location may be at or proximate to a shoulder of the container formed where the container wall flares outward from the lower portion of the neck to assume the outer dimension of the main body. A second loop projects upward from the tag member and encircles a second, minor aperture sized for receiving and encircling the upper portion of the neck of the container. The minor aperture is typically of a reduced or lesser diameter relative to the diameter of the major aperture and also relative to the diameter of the proximate and/or upper portion of the container neck.

Slits are disposed radially about the second loop. The slits are contiguous with the minor aperture at their open ends (proximate the minor aperture) and radiate outwardly therefrom to terminate at the other end, outward or distal from the minor aperture, in relatively small apertures also radially disposed about the second loop. Portions of the second loop located between these slits comprise fingers that grip the outer surface of a proximate, and typically upper, portion of the neck when the assembly is mounted or installed on a container.

The tag member may include a planar cover panel overlying a playback switch for operating an audio circuit housed within the tag member. The cover panel overlies and is attached to a front surface of a first chamber frame. The first chamber frame surrounds and forms an opening or first chamber that is sized to accommodate the audio circuit. A middle panel underlies and is attached to a rear surface of the first chamber frame. The cover panel, first chamber frame and middle panel thereby form the first chamber for housing the audio circuit.

A second chamber frame may be attached to the rear surface of the middle panel. The second chamber frame surrounds and forms an opening or second chamber that is sized to accommodate a transaction card. A back panel underlies and is attached to a rear surface of the second chamber frame. The middle panel, second chamber frame and back panel thereby form the second chamber for housing a transaction card.

Surfaces of the tag may include indicia, words, graphics, or other matter. A rear surface of the back panel may include indicia comprising a product code such as a bar code or UPC code.

Other advantages of the invention will become apparent from the following description taken in connection with the accompanying drawings, wherein is set forth by way of illustration and example one or more embodiments of the present invention.

DETAILED DESCRIPTION

Figures 1, 2:
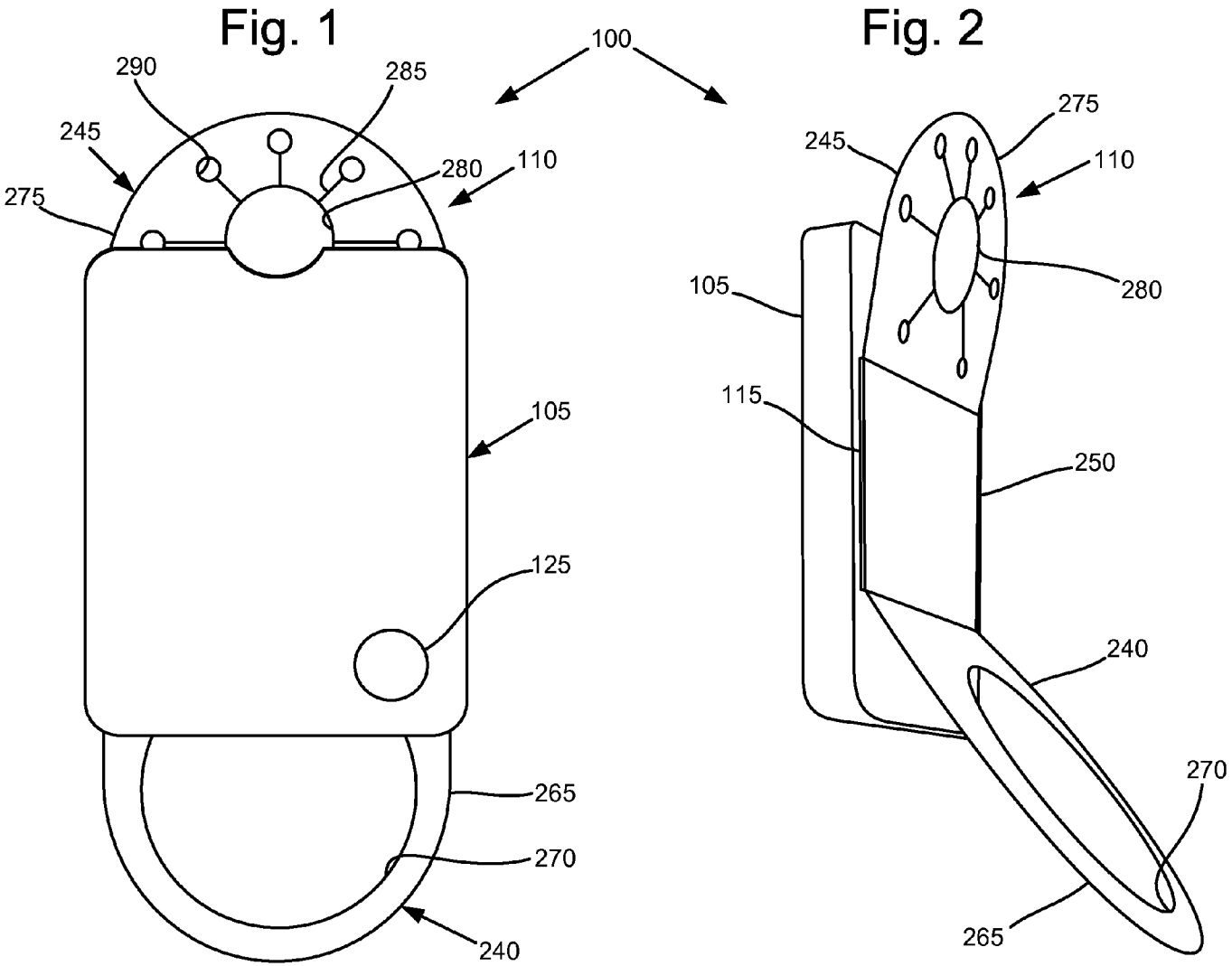
FIG. 1 is a front view of an audio gift tag assembly including a gift tag member mounted upon a container attachment member.
FIG. 2 is a generally rearward perspective view of the assembly of FIG. 1.

As required, one or more detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to FIGS. 1 through 4, there is shown an embodiment of an audio gift tag assembly for a beverage container as indicated generally by the reference numeral 100. The assembly includes the gift tag member 105 and a container attachment member 110. The gift tag member 105 is mounted on and secured to the attachment member 110 using adhesive 115, such as double-sided adhesive tape, or other operative means.

FIG. 1 is a front view of an audio gift tag assembly 100 showing a gift tag member 105 overlying and secured to an attachment member 110. FIG. 2 is a generally rearward perspective view of the assembly 100 of FIG. 1 showing the attachment member 110 secured to the gift tag member 105 via a section of double-sided (also referred to as double-stick) adhesive tape 115.

Figure 3:
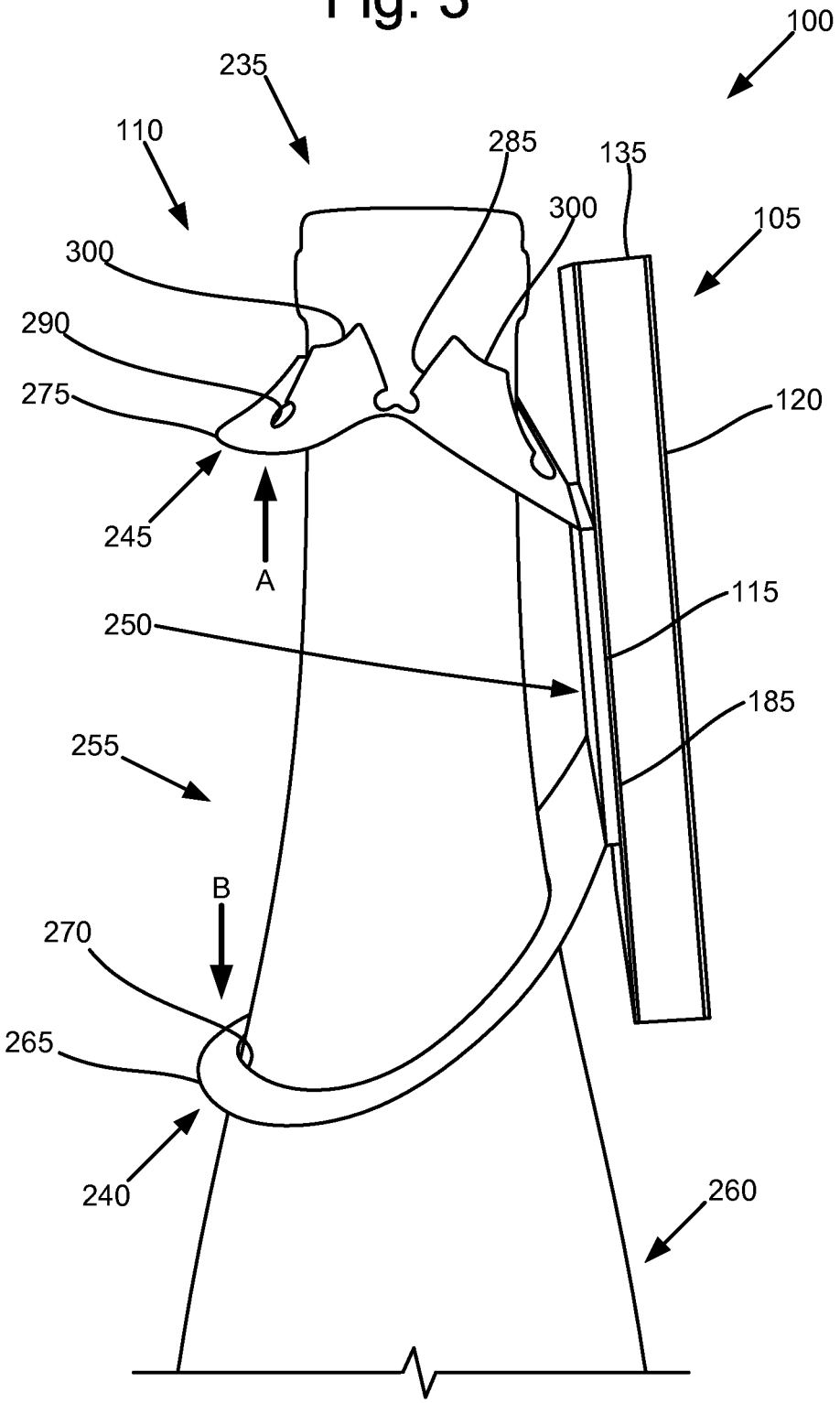
FIG. 3 is a side view of a gift tag assembly installed upon a beverage container having an elongated neck flaring gradually outward and downward to the container body.
Figure 4:
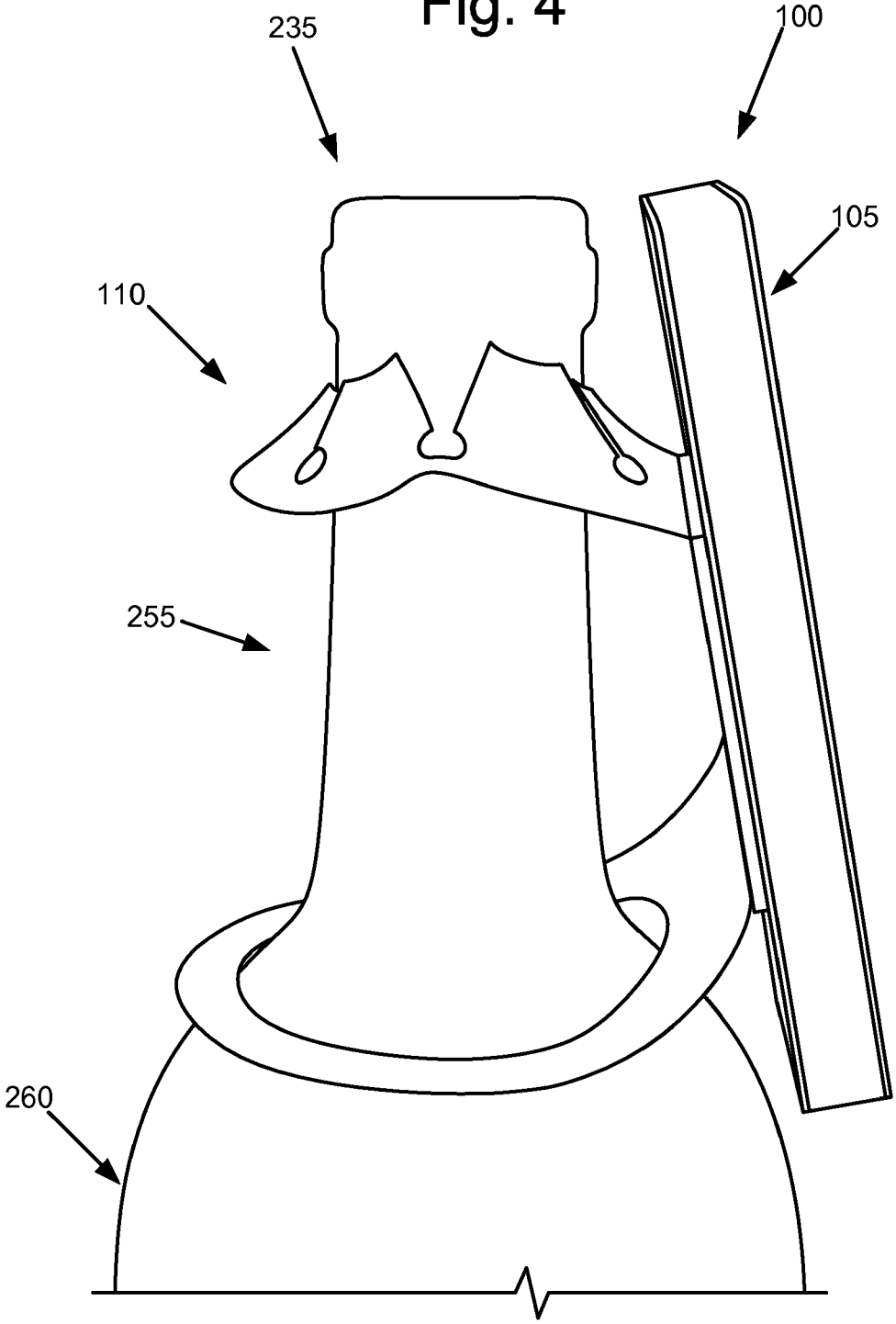
FIG. 4 is a side view of a gift tag assembly installed upon a beverage container having an elongated neck that merges with the container main body at the container shoulder.

The attachment member 110 attaches the gift tag assembly 100 to a container 235, typically a beverage container, and more typically to a container with a constricted neck portion such as the neck 255 of a wine or spirits bottle. It should be appreciated that such a container, though typically used for storing a beverage, may be used for storing other liquids such as olive oil, dressing, sauce, etc., and may also be used to store solid materials, particularly granular materials that may be readily dispensed from such a container. The container may be formed a plastic, glass or equivalent materials as is known in the art. The embodiment of the audio gift tag assembly 100 disclosed herein is particularly designed to be releasably secured to the elongated, constricted neck portion of a beverage container as shown in FIGS. 3 and 4.

Figure 5:
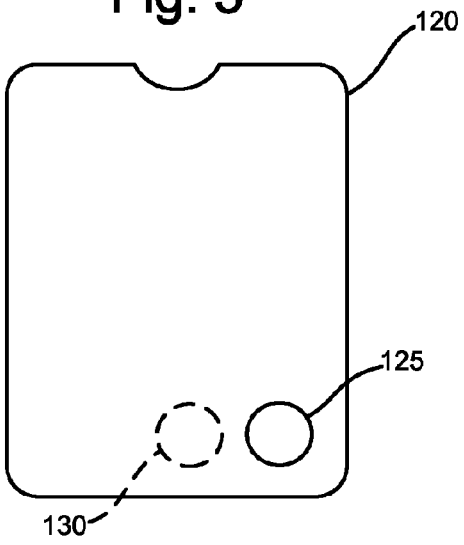
FIG. 5 is a front view of a cover panel.
Figure 6:
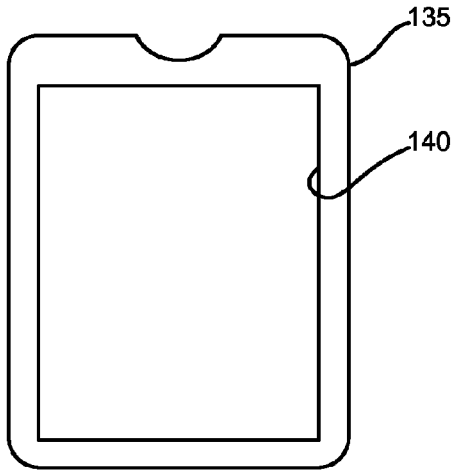
FIG. 6 is a front view of a first chamber frame.

The gift tag member 105 is assembled from multiple, relatively planar elements that are stacked one upon the other in a sandwiched configuration to create a chamber to house audio components and, in some embodiments, a slot or pocket for receiving and storing or housing a stored value transaction card such as a gift card. As illustrated in FIG. 5, a typically rectangular, planar cover panel 120 is typically shaped to extend to the outer margins of the gift tag member 105. The cover panel 120 is formed of paper, cardstock, plastic or other relatively thin resilient material, or a combination thereof, and may include printed indicia, graphics and/or text thereon. Generally, a portion of the cover panel 120 will overlie a playback switch of the audio circuit typically covered by the cover panel 120. First circular indicia 125 may be provided on the front surface of the cover panel 120 to indicate the position of the underlying playback switch. Certain embodiments of a gift tag member 105 may include a record switch for initiating recordation of voice or other ambient sound upon audio circuit memory elements. Second circular indicia 130, shown in phantom lines, may be provided on the front surface of the cover panel 120 to indicate the position of the underlying record switch.

The rear surface of the cover panel 120 is adhered to the front surface of a first chamber frame 135. The first chamber frame 135 comprises a border of cardboard, plastic, expanded or foam rubber, such as ethylene vinyl acetate (EVA), or other relatively thick material. The first chamber frame 135 surrounds a generally central opening 140 sized to surround and accommodate audio circuit components 150 in the major plane of the frame 135. The first chamber frame 135 is also of sufficient thickness to meet or exceed the thickness of audio circuit components 150 held within the frame.

Figure 7:
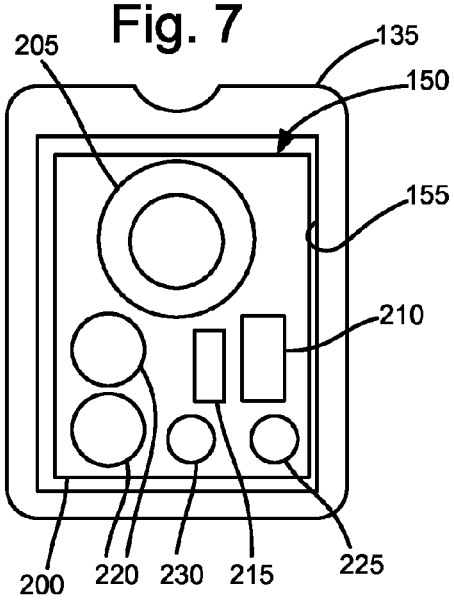
FIG. 7 is a front view of the first chamber frame attached to the front surface of a middle panel.
Figure 8:
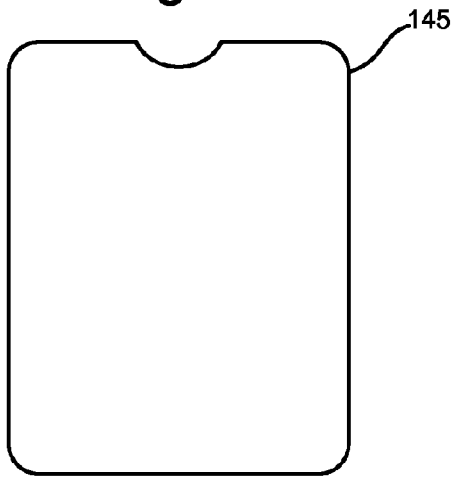
FIG. 8 is a front view of the middle panel.

The rear surface of the first chamber frame 135 is adhered to the front surface (shown in FIG. 8) of a middle panel 145. The middle panel 145 is formed of paper, cardstock, plastic or other relatively thin resilient material, or a combination thereof, and is typically of the same general shape and dimensions as the cover panel 120. FIG. 7 shows the first chamber frame 135 adhered to the middle panel 145 and audio circuit components 150 installed within the first chamber 155. The cover panel 120, first chamber frame 135, and middle panel 145 are thereby attached to one another to form the first chamber 155 for housing the audio circuit components 150, the first chamber 155 being defined by inside surfaces of the first chamber frame 135 (i.e. those inner surfaces of the frame 135 defining the frame opening 140), the portion of the back or rear (and inside) surface of the cover panel 120 exposed to the opening 140, and the portion of the front (and inside) surface of the middle panel 145 exposed to the opening 140.

Figure 9:
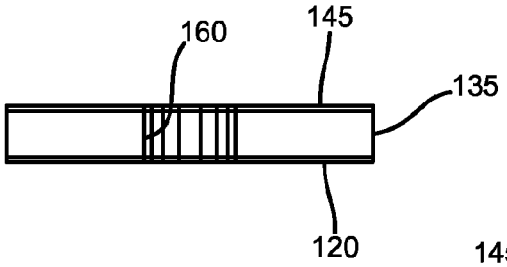
FIG. 9 is a top plan view of the subassembly enclosing the first chamber and showing the finger notch in a top surface of the subassembly.

FIG. 9 is a top plan view of the subassembly comprising the cover panel 120, first chamber frame 135, and middle panel 14, that provides a top view of a finger notch 160 that may be included in the top portion of the cover panel 120, first chamber frame 135, and middle panel 145 in embodiments of the audio gift tag assembly 100 that include a pocket or slot for storing a gift card, as further described below. The finger notch 160 may be used to provide access to a top portion of a gift card 180 when the card 180 is held within an assembly pocket or slot.

Figure 10:
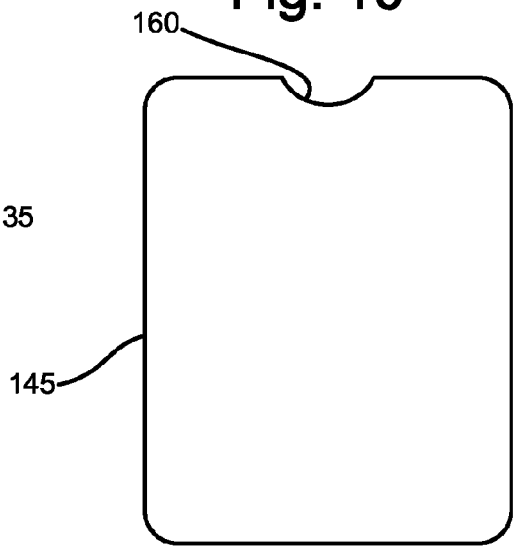
FIG. 10 is a rear view of the middle panel.
Figure 11:
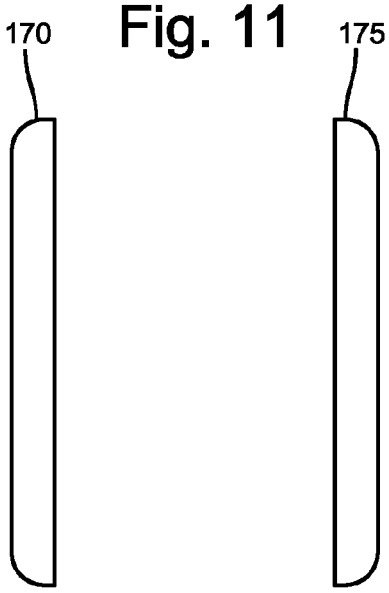
FIG. 11 is a front view of the side elements.
Figure 12:
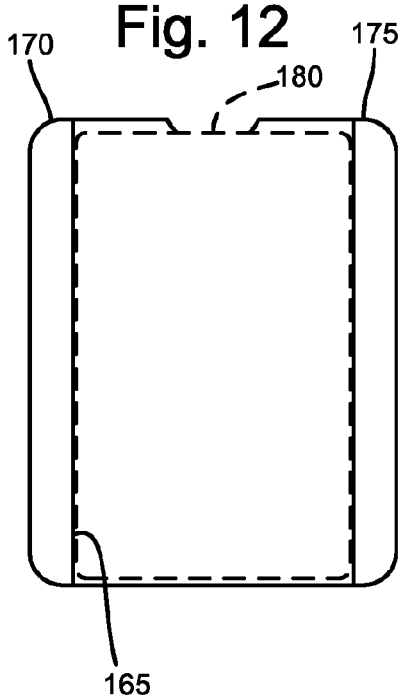
FIG. 12 is a rear view of the middle panel showing the side elements mounted thereon.
Figure 13:
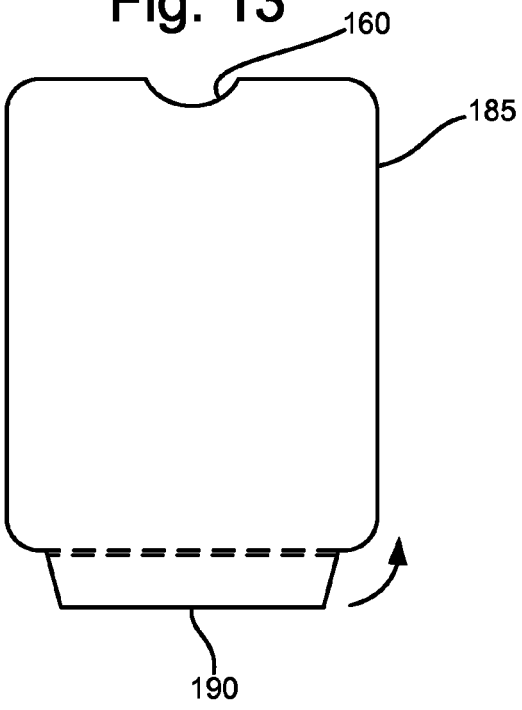
FIG. 13 is a front view of the back panel showing the flap in an unfolded position prior to assembly.

In certain embodiments of the gift tag member 105, a second chamber 165, such as a pocket or slot, is formed for housing a transaction card or stored value card, such as a gift card. To form the second chamber 165, a second chamber frame comprising a first side element 170 and a parallel, transversely opposed second side element 175 are adhered to the rear surface (shown in FIG. 10) of the middle panel 145, as shown in FIG. 12. The side elements 170 and 175 are spaced apart sufficiently to accommodate a gift card (shown in phantom lines 180) placed therebetween. The gift card 180 is not typically installed within the second chamber 165 during assembly of the gift tag member 105 but rather is later inserted into an opening in the top portion of the second chamber 165, said opening comprising the space between the top portions of the inner edges of the side elements 170 and 175.

Figure 14:
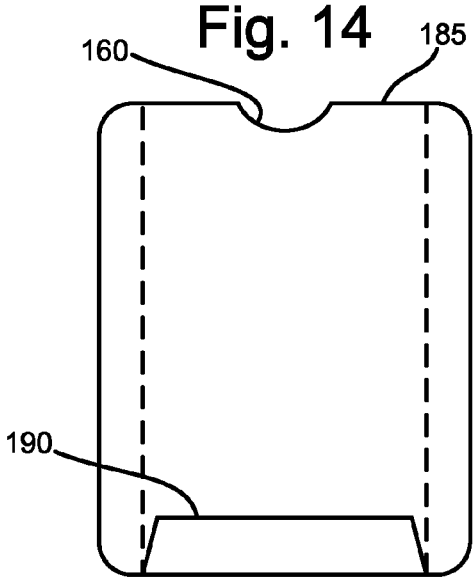
FIG. 14 is a front view of the back panel showing the areas of contact between the back panel and the side elements and showing the flap folded upward and forward.

The front surface of a back panel 185 (see FIGS. 14 and 14) is adhered to the rear surfaces of the side elements 170 and 175 and a flap 190 that projects from the lower margin of the back panel 185 is lifted and folded upward and forward to engage and attach to the lower portion of the rear surface of the middle panel 145 that lies between the side elements 170 and 175. Typically, the flap 190 is adhered to the middle panel 145 using liquid adhesive or double-sided tape. By attaching the folded flap 190 to the rear surface of the middle panel 145, the flap 190 closes the bottom portion of the second chamber 165. The upper portion of the second chamber 165 is left open to receive an inserted gift card 180. The middle panel 145, second chamber frame (170, 175), and back panel 185 are thereby attached to one another to form a second subassembly containing the second chamber 165 for receiving a gift card 180.

Figure 15:
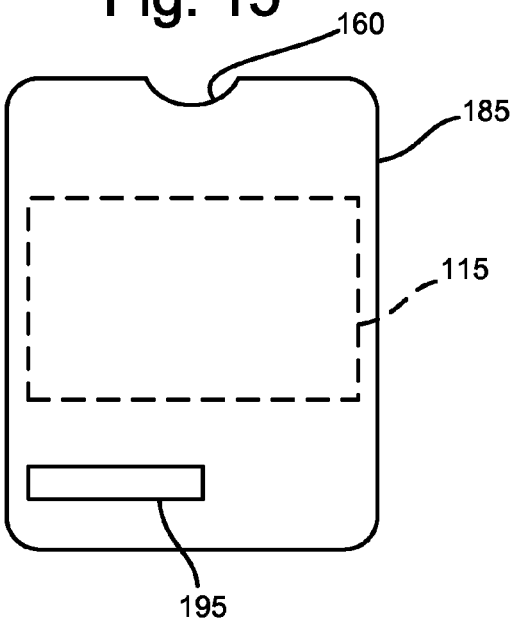
FIG. 15 is a rear view of the back panel.

The rear surface of the back panel 185 may include text, graphics or indicia including a barcode 195 (such as a UPC code) or other product code (see FIG. 15). Phantom lines 115 indicate the general positioning of double-sided adhesive tape or other adhesive upon the rear surface of the back panel 185. The adhesive 115 is used to attach the gift tag member 105 to the attachment member 110.

Figure 16:
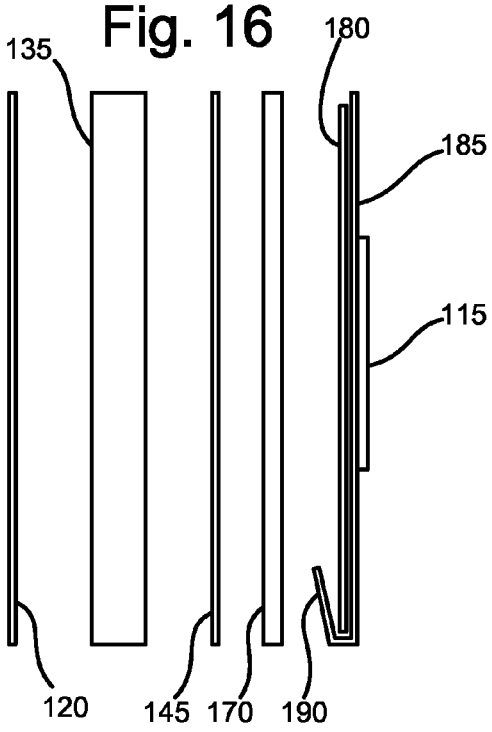
FIG. 16 is a partially exploded side view showing elements of a gift tag member in arranged sequence with one another prior to assembly.
Figure 17:
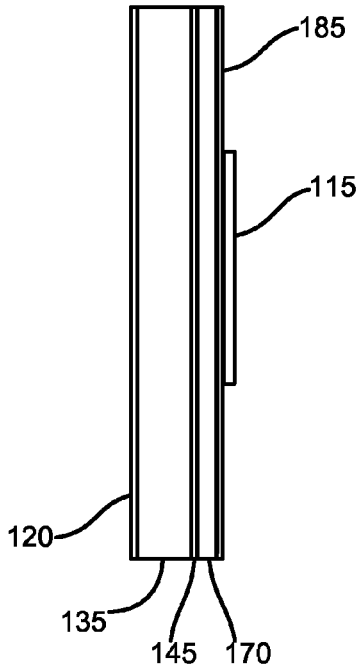
FIG. 17 is a side view of an assembled gift tag member.
Figure 18:
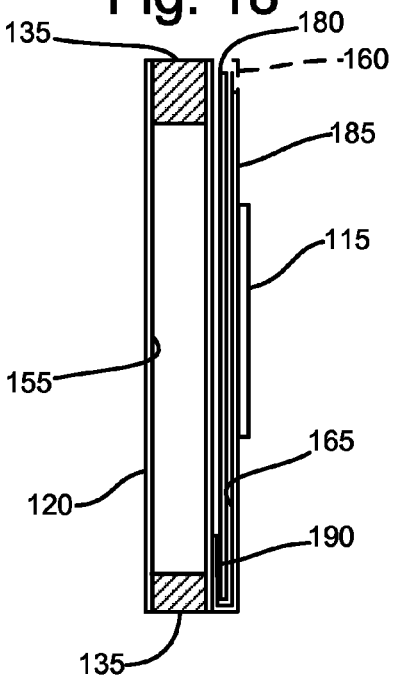
FIG. 18 is a cross-sectional view of a gift tag member.

FIG. 16 is a partially exploded view showing elements of the gift tag member 105 from a side view and in sequence with one another prior to assembly. FIG. 17 is a side view of the gift tag member 105 showing the elements thereof as attached to one another. FIG. 18 is a cross-sectional view of the gift tag member 105 showing flap 190 attached to the middle panel 145, the interior of the first chamber 155 (audio circuit components 150 omitted for clarity), and the interior of the second chamber 165 with a gift card 180 installed therein.

Returning to FIG. 7, the audio circuit 150 housed in the first chamber 155 typically includes a means to play back a sound recording which, in a first embodiment, is prerecorded and provided to the user with purchase of the assembly 100. In a second embodiment, the audio circuit 150 provides means for the user to both record and play back a sound recording. Components used for such an audio circuit 150, and such circuits themselves, are well known in the art and therefore will be described briefly. Typically, the circuit components are mounted on a circuit board 200 that is sized to fit within the opening 140 and within the first chamber 155, which may also be referred to as the audio circuit chamber. A speaker 205 for playing sound is mounted to the circuit board 200 or otherwise secured within the chamber 155. In an assembly 100 according to the second embodiment, the speaker 205 typically also functions as a microphone for recording sound, however, a separate microphone component may also be provided. A digital memory chip 210 and a digital control circuit or processor chip 215 are also typically provided to store and process audio signals. One or more batteries 220, typically thin profile watch-type batteries, provide electrical power to the circuit 150. A playback switch or button 225 is provided to initiate a playback sequence in the processor 215 by initiating power supply to the processor 215. A record switch or button 230 is also provided for initiating a record sequence in the processor 215 in an assembly 100 according to the second embodiment. Because the playback switch 225 and record switch 230 are hidden from view by the cover panel 120, as are the other circuit components 150, the positions of the underlying switches 225 and 230 are typically indicated on the cover panel 120 via indicia 125 and 130, respectively. Indicia 125 and 130 may include a printed shape, letter or words, or any other indicia operable to convey switch locations and functions. In a third embodiment of the assembly 100, a single switch may be used to initiate both record and playback sequences, typically by pressing the switch for a particular duration or for a particular number of times to select record or playback mode. Such configurations are well known in the art.

Referring now to FIGS. 1-4, 19 and 20, the attachment member 110 is shown in various dispositions. The attachment member 110 typically comprises thin plastic or other resilient material such as cardboard. Plastic may be preferred in some embodiments due to direct engagement of the attachment member 110 to a beverage container 235, such as the wine bottles shown in FIGS. 3 and 4, which may bear condensation on the surface if removed from refrigeration or subjected to temperature fluctuations during transport. The attachment member 110 is elongate and includes three major elements, a first attachment element 240, a second attachment element 245 distal from the first attachment element, and a third attachment element 250 intermediate to and connecting the first and second attachment elements. The first attachment element 240 and second attachment element 245 include structures for attaching the attachment member 110, and thereby the audio gift tag assembly 100, to a container, typically a beverage container 235, and more typically to a container with an elongated constricted neck 255 that flares outward and downward to the main body 260 of the container 235, such as the neck 255 of a wine or spirits bottle 235. The embodiment of the attachment member 110 disclosed herein is designed to be releasably secured to the neck 255 of a beverage container 235 of the general types shown in FIGS. 3 and 4. The third attachment element 250 is typically a generally rectangular, relatively planar, middle section of the attachment member 110 that forms the attachment point to the gift tag member 105 via double-sided adhesive tape 115 or other operable means.

In the embodiment of the attachment member 110 disclosed herein, the first attachment element 240 comprises a first loop 265 that encircles a first or major aperture 270 for receiving the lower portion of the neck 255, as shown in FIG. 3, or the upper portion of the main body 260, as shown in FIG. 4. When the assembly 100 is installed upon a container 235, the first loop 265 typically rests upon the adjoining surface of the container 235.

The second attachment element 245 comprises a second loop 275 that encircles a second or minor aperture 280 that is typically of reduced or lesser diameter relative to the diameter of the major aperture 270 and also of reduced diameter relative to the diameter of the upper portion of the neck 255. Radial slits 285 are contiguous with the minor aperture 280 and radiate outward therefrom to terminate in small apertures or holes 290. As shown in FIGS. 3 and 4, when the upper portion of the neck 255 is passed through the second loop 275, portions of the second loop 275 in between the slits 285 are deflected upward to increase the size of the minor aperture 280 while remaining in pressed engagement against the side of the neck 255. Due to the resiliency of the material selected to comprise the attachment member 110, these gripping portions or fingers 300 press tightly against the outer surface of the neck 255. In some installations, the inner (and also upper when disposed as shown in FIGS. 3 and 4) margins of the fingers 300 also abut a ring or collar projecting outward from the neck 255 proximate to the upper end or lip of the neck 300. The gift tag member 105 illustrated in FIGS. 3 and 4 is according to an alternative embodiment omitting the second chamber 165, middle panel 145 and gift card 180.

As indicated by vector arrows A and B in FIG. 3, when the assembly 100 is installed upon a container 235, the first 240 and second 245 attachment elements are each bent from a generally vertical resting position to a generally horizontal working or engagement position and, therefore, element 245 tends to press or be biased upward in the general direction of arrow A and element 240 tends to press or be biased downward in the general direction of arrow B. Such spring pressure bias causes the attachment member 210 to be further and more tightly engaged with the container 235.

Figure 19:
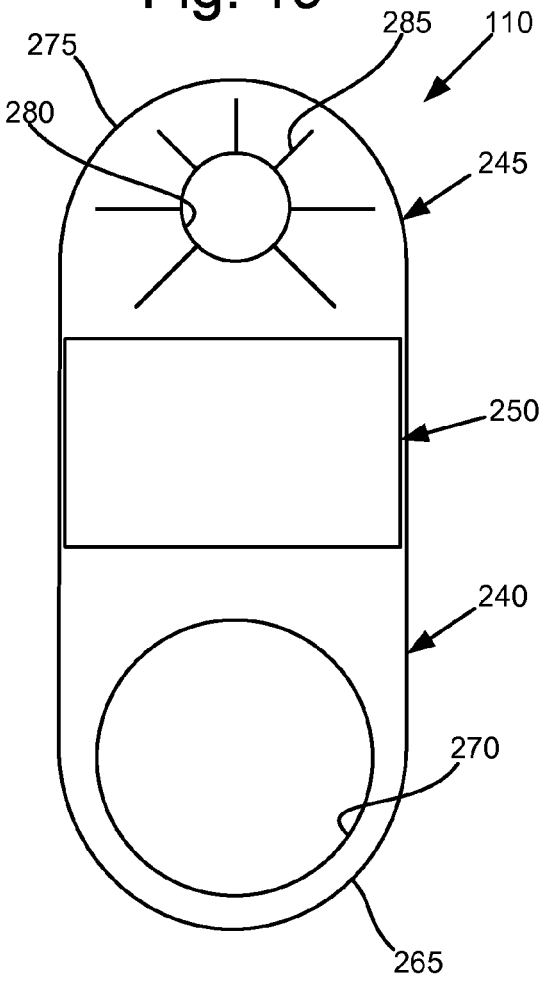
FIG. 19 is a front view of an attachment member.
Figure 20:
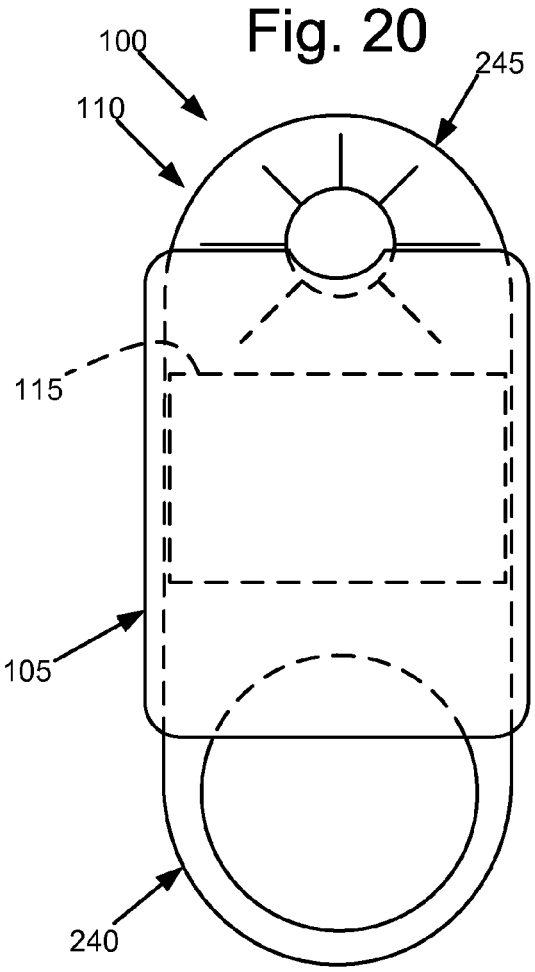
FIG. 20 is a front view of a gift tag member attached to the attachment member of FIG. 19.

Turning to FIGS. 19 and 20, FIG. 19 is a front view of an attachment member 110 including a portion of double-sided adhesive tape 115 positioned upon and attached to the third attachment element 250. It should be appreciated that the tape 115, or other selected adhesive, may be first attached to either the attachment member 110, as shown in FIGS. 19 and 20, or to the gift tag member 105, as shown in FIGS. 16-18. FIG. 20 shows a gift tag member 105 attached to the attachment member 110 of FIG. 19 via the adhesive tape 115, thereby completing the audio gift tag assembly 100. Major elements of the attachment member 110 that underlie the attached gift tag member 105 are drawn in phantom lines.

Having thus described the invention, what is claimed as new and desired to be secured by Letters Patent is:

1. An audio tag assembly for attachment to the neck of a container, the assembly comprising:

a tag member mounted on a container attachment member, said tag member comprising a chamber to house audio components, a slot for receiving and storing a transaction card, said attachment member comprising a first loop encircling a first aperture and a second loop encircling a second aperture, said first loop biased downward and said second loop biased upward, whereby said first loop and said second loop exert pressure against the outer surface of said container when said assembly is mounted upon said container.

2. The assembly of claim 1 wherein said first aperture comprises a major aperture sized for receiving and encircling the lower portion of the neck of a container and said second aperture comprises a minor aperture sized for receiving and encircling the upper portion of said neck of said container.

3. The assembly of claim 2 wherein said second aperture has a reduced diameter relative to the diameter of the proximate portion of said neck.

4. The assembly of claim 2 further comprising slits contiguous with said minor aperture and radiating outward therefrom and through a portion of said second loop.

5. The assembly of claim 4 wherein portions of said second loop between said slits comprise fingers that grip the outer surface of a proximate portion of said neck.

6. The assembly of claim 4 wherein said slits are disposed radially about said second loop and open at one end to said minor aperture and terminate at another end outward from said minor aperture in small apertures radially disposed about said second loop.

7. The assembly of claim 1 wherein said tag member comprises a planar cover panel overlying a playback switch for operating an audio circuit housed within said tag member, said cover panel overlying and attached to a front surface of a first chamber frame, said first chamber frame surrounding an opening sized to accommodate said audio circuit, a middle panel underlying and attached to a rear surface of said first chamber frame, said cover panel, first chamber frame and middle panel thereby forming a first chamber for housing said audio circuit, a second chamber frame attached to the rear surface of said middle panel, said second chamber frame sized to accommodate a transaction card, and a back panel underlying and attached to a rear surface of said second chamber frame, said middle panel, second chamber frame and back panel thereby forming a second chamber for housing a transaction card.

8. The assembly of claim 7 further comprising indicia on a rear surface of said back panel.

9. The assembly of claim 8 wherein said indicia comprises a product code.

10. An audio tag assembly for attachment to the neck of a container, the assembly comprising:

a tag member mounted on a container attachment member, said tag member comprising a chamber to house audio components, a slot for receiving and storing a transaction card, a planar cover panel overlying a playback switch for operating an audio circuit housed within said tag member, said cover panel overlying and attached to a front surface of a first chamber frame, said first chamber frame surrounding an opening sized to accommodate said audio circuit, a middle panel underlying and attached to a rear surface of said first chamber frame, said cover panel, first chamber frame and middle panel thereby forming a first chamber for housing said audio circuit, a second chamber frame attached to the rear surface of said middle panel, said second chamber frame sized to accommodate a transaction card, a back panel underlying and attached to a rear surface of said second chamber frame, said middle panel, second chamber frame and back panel thereby forming a second chamber for housing a transaction card, said attachment member formed of resilient material and comprising a first loop encircling a first aperture and a second loop encircling a second aperture, said apertures sized for receiving and encircling the neck of said container, whereby said first loop and said second loop exert pressure against said container when said assembly is mounted upon said container.

* * * * *